US005791026A

United States Patent [19]

Anscher

[11] Patent Number: 5,791,026

[45] Date of Patent: Aug. 11, 1998

[54] SIDE-RELEASE BUCKLE HAVING RETAINING STRAPS

[75] Inventor: Joseph Anscher, Muttontown, N.Y.

[73] Assignee: National Molding Corporation, Farmingdale, N.Y.

[21] Appl. No.: 866,864

[22] Filed: May 30, 1997

[51] Int. Cl.[6] ..... A44B 11/25

[52] U.S. Cl. ..... 24/615; 24/625

[58] Field of Search ..... 24/614, 615, 616, 24/625

[56] References Cited

U.S. PATENT DOCUMENTS 1,477,597 12/1923 Schneider ..... 24/616

4,639,982 2/1987 Kasai ..... 24/616

5,222,279 6/1993 Frano et al. ..... 24/625

5,465,472 11/1995 Matoba ..... 24/625

*Primary Examiner*—James R. Brittain

*Attorney, Agent, or Firm*—Kenyon & Kenyon

[57] ABSTRACT

A side release buckle having a retaining strap includes a male plug member and a female socket member. The plug member has a pair of resiliently flexible arm members and a center piece. A retaining strap is disposed between each arm member and the center piece near the distal end of the male plug member. The retaining strap acts to prevent outward extension of the flexible arm members beyond a breaking point. The retaining strap also allows for minimal resistance for inward flexing of the arm members during normal operation of the buckle.

26 Claims, 4 Drawing Sheets

FIG. 2
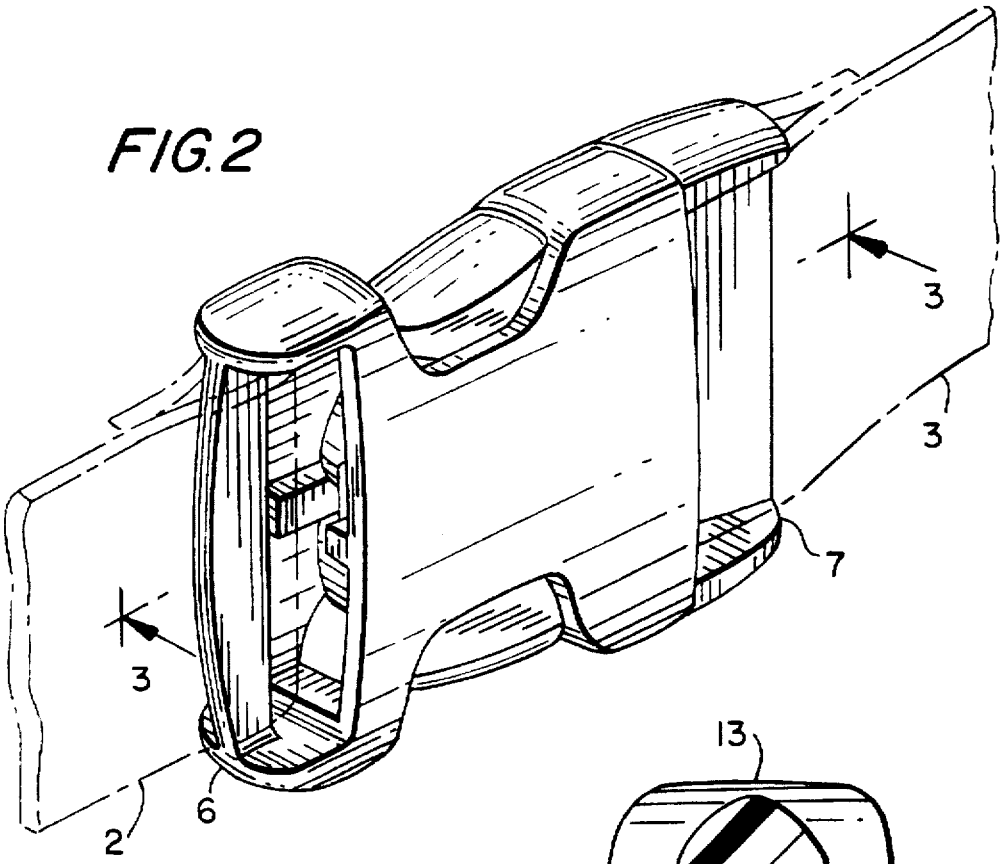
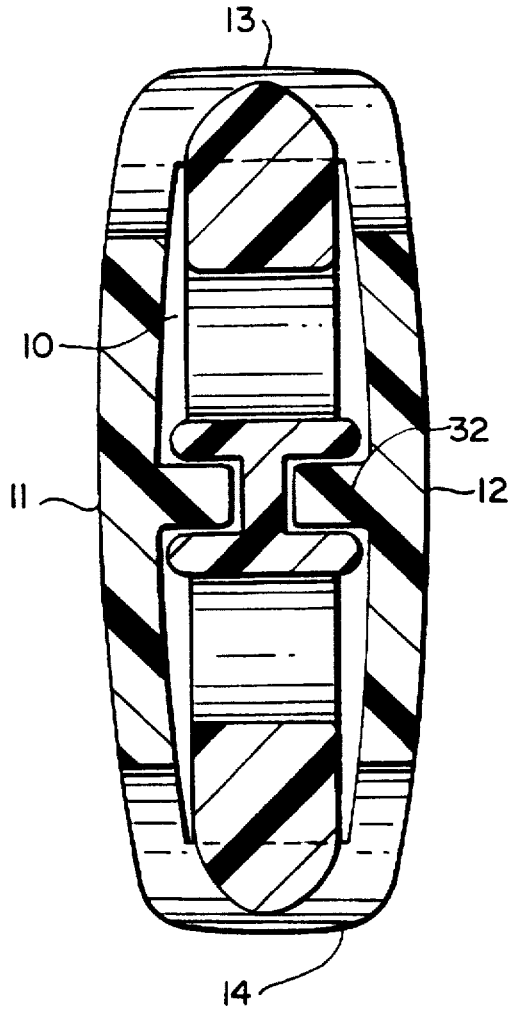
FIG. 4

SIDE-RELEASE BUCKLE HAVING RETAINING STRAPS

BACKGROUND OF THE INVENTION

1. Field of the Invention

The invention relates generally to side-release buckles of the type having a female receptacle member and a mating male plug member which are releasably lockable together. More particularly, the invention relates to such a side-release buckle wherein the male member includes a retaining strap between each arm of the male member so as to prevent overextension of each arm beyond a breaking point.

2. Description of Related Art

Assorted two-piece buckles are known in the art. These buckles typically include a female receptacle or socket member which is engageable with a male latch or plug member. One or both of the members adjustably or fixedly holds a strap or belt around crossbars or the like. One particularly common form of a two-piece buckle is one in which the plug member includes a pair of arms which, when inserted into the socket member, flex inwardly and slide forward in the socket until they snap fit into respective side openings in the socket. The two buckle pieces are unlocked and disengaged by squeezing the arms of the male member through the openings in the female member between the thumb and forefinger, thereby freeing the shoulders defined in the arms from the respective side openings in the female member and allowing the two buckle pieces to become separated.

As the arms of the male member are designed to be flexible (to allow interlocking and releasing with the female member), it is possible to outwardly overextend the arms of the male member, causing the arms to break off. Although extension of the arms in this fashion is not part of the intended normal operation of the side-release buckle, situations may arise in use where a person will attempt to overextend an arm of the male member. For example, a child may attempt to overextend the arms of the male member in the course of operating the buckle, causing the arms to break off, and the buckle to therefore fail.

It would therefore be desirable to provide a side-release buckle wherein the arms of the male member were strengthened against overextension such that breakage would not occur, without decreasing the flexibility of the arms. It would also be desirable to devise a strengthened male member design that could be manufactured without needing additional manufacturing steps.

SUMMARY OF THE INVENTION

A first embodiment of the invention is a side-release-type buckle having a female socket member and a male latch or plug member. The female member defines a socket or receptacle therein having an open end. The male member includes at least one arm for insertion into the socket through the open end of the female member. The male member includes at least one resiliently flexible arm projecting from a base thereof which is adapted to be inserted into the socket member. The plug further includes a rigid center piece projecting from the base thereof in the same direction as the resiliently flexible arm. A region at or near the distal end of the arm(s) defines a protrusion on the outside side surface of the arm. The protrusion defines a shoulder which extends from the outer side of the arm. The female socket member includes at least one aperture defined through a side wall thereof for exposing the protrusion of the arm belonging to the male plug member, when the plug member is fully inserted into the socket member.

The plug member is formed with a retaining strap connected between the center piece and each resiliently flexible arm. Each retaining strap is preferably formed as a V-shaped piece, such that outward flexing of the arm of the plug member causes the retaining strap to straighten and inward flexing of the arm causes the retaining strap to fold. When the retaining strap has become completely straight, the arm is prevented from being flexed outwardly any further amount, thereby preventing overextension of the arm. The retaining strap can be formed between any arm and the center piece. The retaining strap can be advantageously formed during the molding process of the plug member, thereby avoiding the need to make further modifications to the plug member after formation.

To separate the male member from the female member, the protrusions of the arms are merely pushed inward into the aperture in the side walls of the female socket member until the shoulders clear the stop members. The resilient force now supplied by the inwardly flexed arms will urge the plug member to spring out of the socket member, thereby disengaging the buckle pieces. For the preferred implementation of a V-shaped retaining strap, the retaining strap allows inward flexing of the arms by becoming folded with the application of inward force on the arms.

In a second embodiment of the present invention, a side-release buckle has a male member where multiple retaining straps are used between each arm and the center piece. The retaining straps are preferably V-shaped, and formed opposingly in a diamond arrangement to prevent interference with each other during flexing of the arms.

In a third embodiment of the present invention, a side-release buckle has a male member having a center piece comprising multiple rigid projections extending outwardly from the base of the male plug member, and a restraining strap is connected between each rigid projection and each resiliently flexible arm.

BRIEF DESCRIPTION OF THE DRAWINGS

Various other objects, features and advantages of the present invention will be more fully appreciated from the following detailed description of the preferred embodiments, when considered in connection with the accompanying drawings, in which like reference characters designate like or corresponding parts throughout the several views, and wherein:

FIG. 2 is a perspective view of the side release type buckle of FIG. 1, wherein the male and female members are coupled.

FIG. 4 is a side cross-sectional view of the buckle of FIG. 3, taken along the line 4—4.

DETAILED DESCRIPTION OF THE INVENTION

Figure 1:
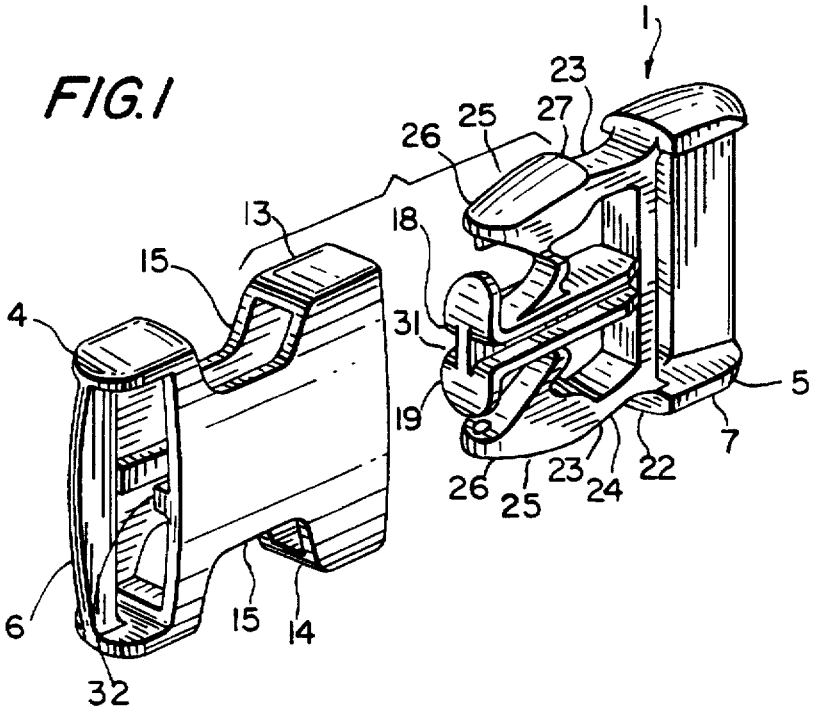
FIG. 1 is a perspective view of a side release type buckle according to a first embodiment of the present invention wherein the male and female members are separated.

Referring to FIGS. 1–4, a side-release buckle in accordance with a first embodiment of the present invention is designated generally by the reference numeral 1. The buckle 1 is typically used to connect free-ends of straps 2,3 (see FIG. 2). The buckle 1 is generally comprised of two pieces, a female socket member 4 and a complementary male plug member 5.

The buckle 1 is preferably molded from some type of plastic or resin, but any suitable material known in the art for molding or machining side-release type buckles may be used.

The socket member 4 includes a single cross bar 6 at its proximal end. Strap 2 can be looped around cross bar 6 and then stitched to itself to permanently secure the strap 2 to cross bar 6. The male plug member 5 includes a cross bar 7 at it proximal end, and strap 3 can be looped around cross bar 7 and then stitched to itself to permanently secure the strap 3 to cross bar 7. The male plug member 5 can alternately include a pair of cross bars 7 at its proximal end which can receive strap 3 in a well known manner such that the strap is adjustable, for example, as described in U.S. Pat. No. 5,216,786. Alternatively, a pair of cross bars 6 may be provided on the female socket member and a single cross bar 7 may be provided on the male member.

The socket member 4 preferably has a flat rectangular tubular cross-sectional configuration as illustrated in FIG. 4, having a substantially rectangular shaped interior cavity 10. The cavity 10 is defined as the area between a top wall 11, an opposing bottom wall 12 and a pair of side walls 13 and 14, each of which connects the top wall to the bottom wall at the side edges thereof. The top and bottom walls 11 and 12 are typically much wider than the side walls 13 and 14, as illustrated, so that the socket member has a substantially flat or rectangular shape.

The male plug member 5 is received and releasably locked within the cavity 10 of the female socket member 4 via shoulder-latching surfaces defined on shoulders which are associated with the male member (described below). The female socket member 4 includes an aperture 15 defined in each side wall 13 and 14 thereof. The apertures 15 cooperate with the latching surfaces associated with the male plug member 5 to retain and lock the plug member 5 within the socket member 4. The apertures 15 also enable the user to access the male plug member 5 from the exterior of the socket member 4 to allow for release of the two buckle pieces (see FIGS. 1 and 2). Each aperture 15 extends at least through a portion of the opposing side walls 13 and 14, to form a side-release type buckle 1. However, as will be appreciated by those skilled in the art, the particular shape, location, position and number of apertures 15 can vary so long as the side-release buckle 1 functions substantially as described herein.

The male plug member 5 includes a proximal base portion 22 which is attached to two resiliently flexible arm members 23. Arm members 23 project in the distal direction from the base 22. The pair of arm members 23 have a predetermined length, and run along opposite sides of the male plug member 5. A center piece 18 also projects in the distal direction from the base 22, and is centrally located between each arm member 23. As shown in FIGS. 1 and 2, center piece 18 may have a cap portion 19 at the distal end thereof and may also have grooves 31 running through the top and bottom portions of center piece 18. Center piece 18 can alternatively be implemented without cap portion 19 or without grooves 31. Where center piece 18 includes grooves 31, female socket member 4 may include ribs 32 on the interior of top and bottom walls 11, 12, such that the ribs 32 engage the grooves 31 of the center piece 18 when the male member 4 and female member 5 are interconnected.

Figure 3:
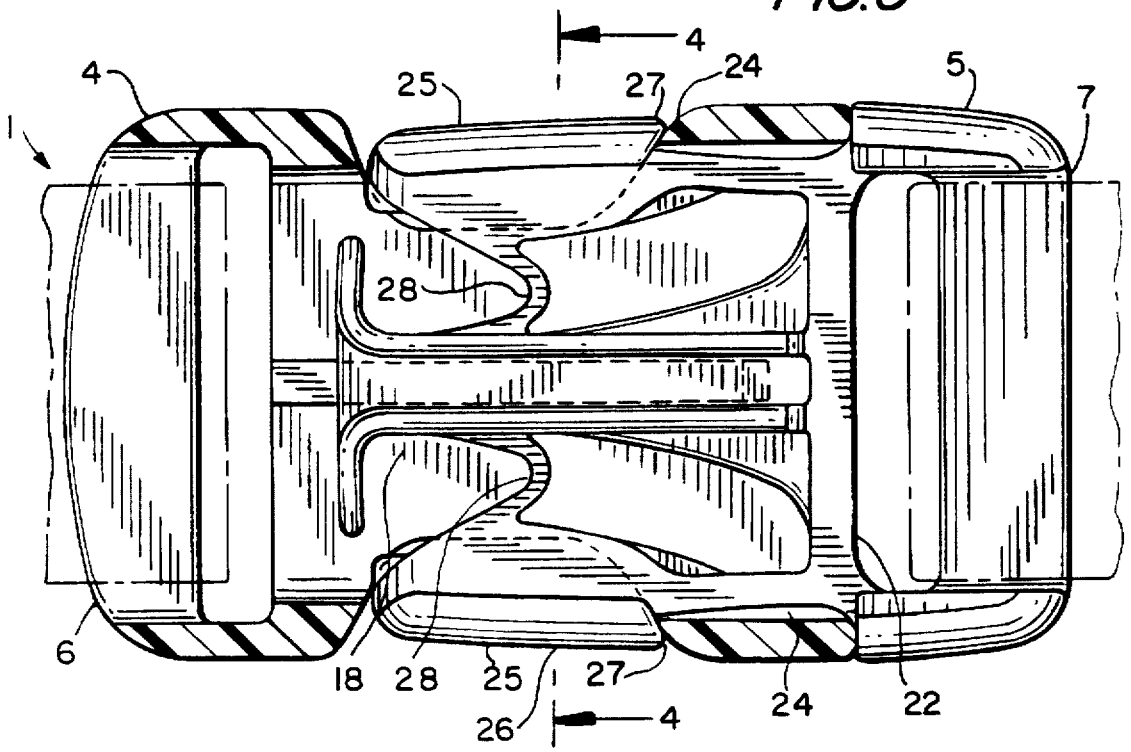
FIG. 3 is a top cross-sectional view of the buckle of FIG. 2 showing the interlocking of the male and female members.

Each arm member 23 includes a first proximal end 24 which is attached to the base portion 22 and a second opposite distal end 25. To facilitate access to the user of the buckle, the distal end 25 of each arm member 23 is formed with a protrusion or bulbous region 26 on its outer side surface. The proximal end of each protrusion defines a shoulder-latching surface 27. As illustrated in FIG. 3, the shoulder-latching surface 27 is generally V shaped. However, the shoulder-latching surface 27 may be other configurations, as will be known to those in the art, for causing an interlocking connection between the arm members 23 of the male member 5 and the apertures 15 of the female socket member 4, as described above.

In the first embodiment of the present invention, the male member 5 includes flexible retaining members or straps 28 as shown in FIGS. 2 and 3. Each retaining strap 28 is connected at a first end to center piece 18 and at a second end to a respective arm member 23 of the male member 5. The respective connections are made toward the distal end of the male plug member 5. The retaining straps 28 can be molded in the same manner and from the same material (e.g., plastic resin) as the other structures of male member 5, and thus no additional manufacturing steps are needed. Alternatively, the flexible retaining straps may be a web or fabric, for example nylon, which is permanently attached in the same location as above described.

The retaining straps may be implemented in many shapes, however, a preferred shape for retaining straps 28 is a V-shape. As will be discussed further below, the V-shape retaining strap allows each arm member to outwardly flex only to a certain point (predetermined by the length of the retaining strap), and allows each arm member to inwardly flex with minimal impedance.

To releasably connect the male plug member 5 to the socket member 4, the distal end 25 of each arm member 23 is first inserted within the cavity 10. Upon continued insertion, the distal ends 25 and protrusions 26 of each arm member 23 will contact the side walls 13,14 of the female member 4, and each arm member 23 will be flexed inward toward the interior of the cavity 10. The retaining straps 28, upon application of inward force by the inwardly flexing arm members 23, will fold at the vertex of the V-shape, thus causing minimal resistance to the inward flexing of the arm members 23. Further insertion of the male member 5 will result in the protrusions 26 moving into the apertures 15, at which point each arm member 23 snaps outward with respect to the cavity 10. In this position, each shoulder-latching surface 27 engages the respective side wall 13,14. It can be seen from FIGS. 2 and 3 that in this locked position, the protrusion 26 of each arm member 23 extends out from the sides of the socket member 4 through the aperture 15.

To release the male plug member 5 from the cavity 10, a user exerts inward force against the protrusions 26 through apertures 15 into the cavity 10 to flex the arm members 23 inward with respect to the cavity 10. Once again, the retaining straps 28, upon application of inward force, fold along the vertex of the V-shape, and produce minimal resistance to the inward flexing of the arm members 23.

Once the shoulder-latching surfaces 27 of the arm members 23 clear the edges of the side walls 13,14, the male plug member 5 can be removed from the female socket member 4. The resilient force exerted by the arm members 23 flexed inwardly will facilitate the "springing out" of the plug member from the cavity 10. In addition, the rounded outside side surfaces of the protrusions 26 will also facilitate easy separation of the plug member 5 from the socket member 4.

As described above, in normal operation of the buckle 1, the retaining straps 28 are implemented so as to not impede the coupling/decoupling process. However, there may be situations where the buckle 1 is operated in an abnormal manner. For example, a force may be exerted on an arm member 23 such that the arm member 23 is caused to flex outwardly, that is, away from the center piece 18. In such a situation, the retaining strap 28 that is connected to arm member 23 is forced to "straighten" as the arm member becomes outwardly extended. When the retaining strap 28 becomes substantially "straightened," the retaining strap 28 resists further flexing of the arm member 23, and thus acts to limit the outward flexing of the arm member 23. The arm member 23 will thus be prevented from becoming extended beyond its breaking point.

Figure 5:
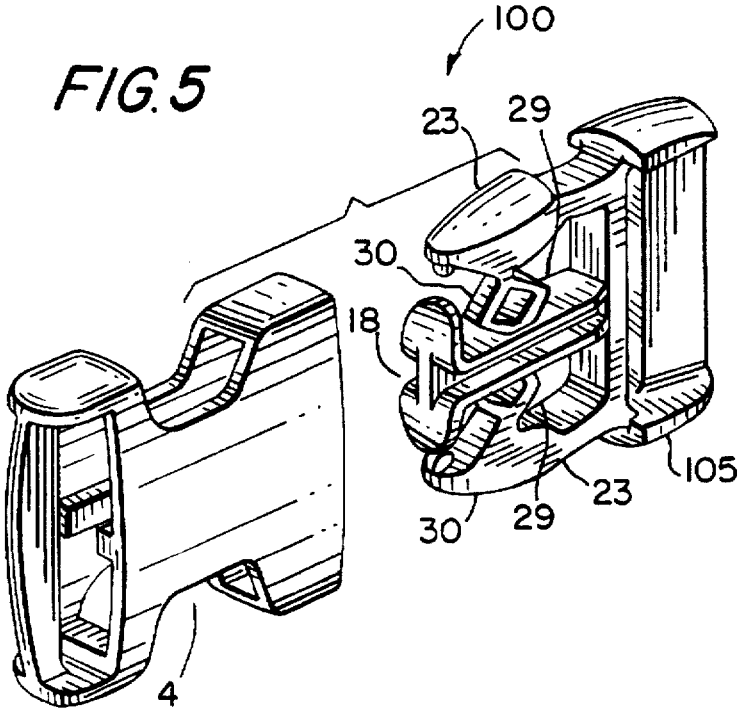
FIG. 5 is a perspective view of a second exemplary embodiment of a side release buckle in accordance with the present invention, wherein the male and female members are separated.
Figure 6:
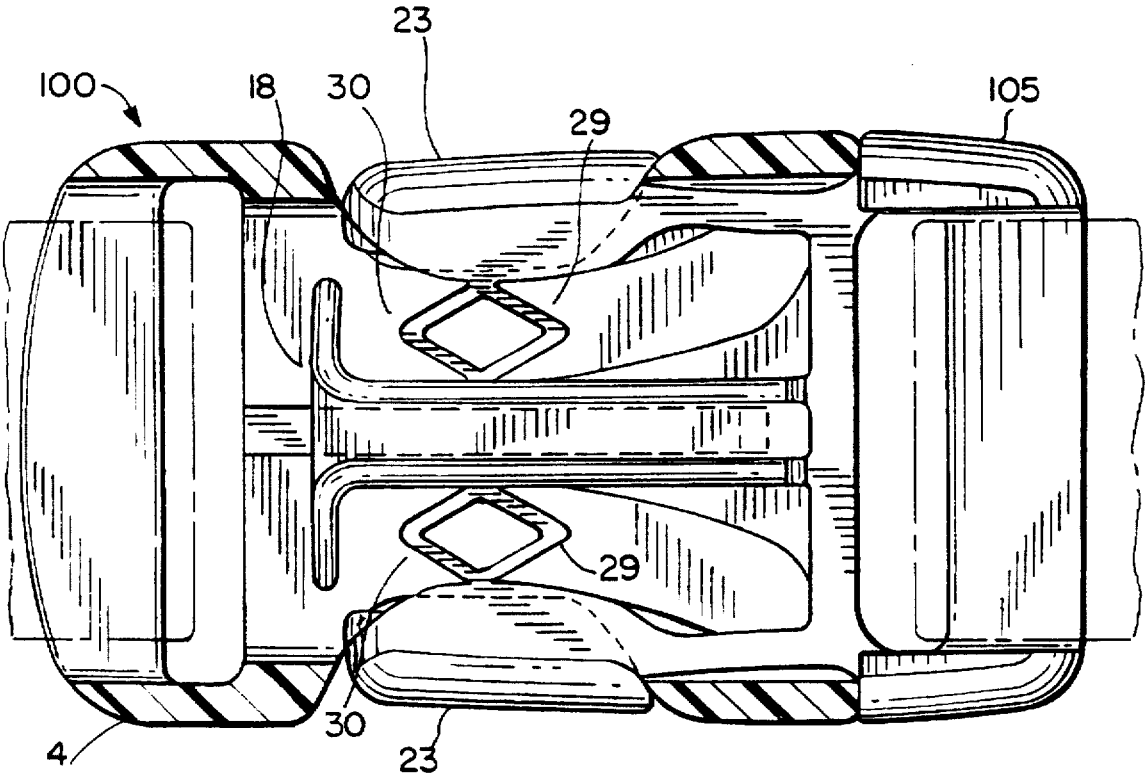
FIG. 6 is a top cross-sectional view of the buckle of FIG. 5 showing the interlocking of the male and female members.

A second exemplary embodiment of a side-release type buckle according to the present invention is shown in FIGS. 5 and 6. A buckle 100 has a male member 105 and a female member 4. Male member 105 is implemented in a manner similar to male member 5 of the first exemplary embodiment, except that multiple retaining straps 29,30 are formed between each arm member 23 and the center piece 18. As shown in FIG. 6, a preferred implementation of multiple retaining straps 29,30 is in a diamond-shaped arrangement of V-shaped retaining straps, with first retaining strap 29 having a vertex located toward the proximal end of male member 105 and second retaining strap 30 having a vertex located toward the distal end of male member 105.

The operation of buckle 100 according to the second exemplary embodiment of the present invention is similar to that of buckle 1 of the first exemplary embodiment. When the arm members 23 are inwardly flexed, the retaining straps 29,30 are folded at their vertices to allow minimal resistance for the inward flexing of the arm members 23. As the retaining straps 29,30 are arranged with oppositely located vertices, the folding of the first retaining strap 29 will not interfere with the folding of the second retaining strap 30, and vice versa. Likewise, when the arm members 23 are outwardly flexed, the retaining straps 29,30 are straightened and, once substantially straight, will act to limit the outward flex of the arm members 23, and prevent breakage.

Figure 7:
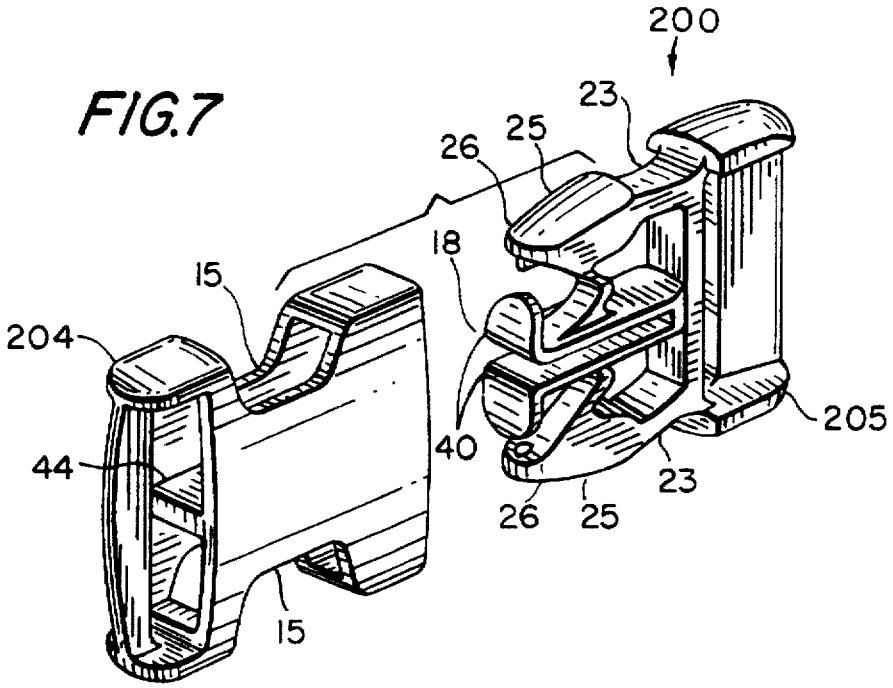
FIG. 7 is a perspective view of a third exemplary embodiment of a side-release buckle in accordance with the present invention, wherein the male and female members are separated.
Figure 8:
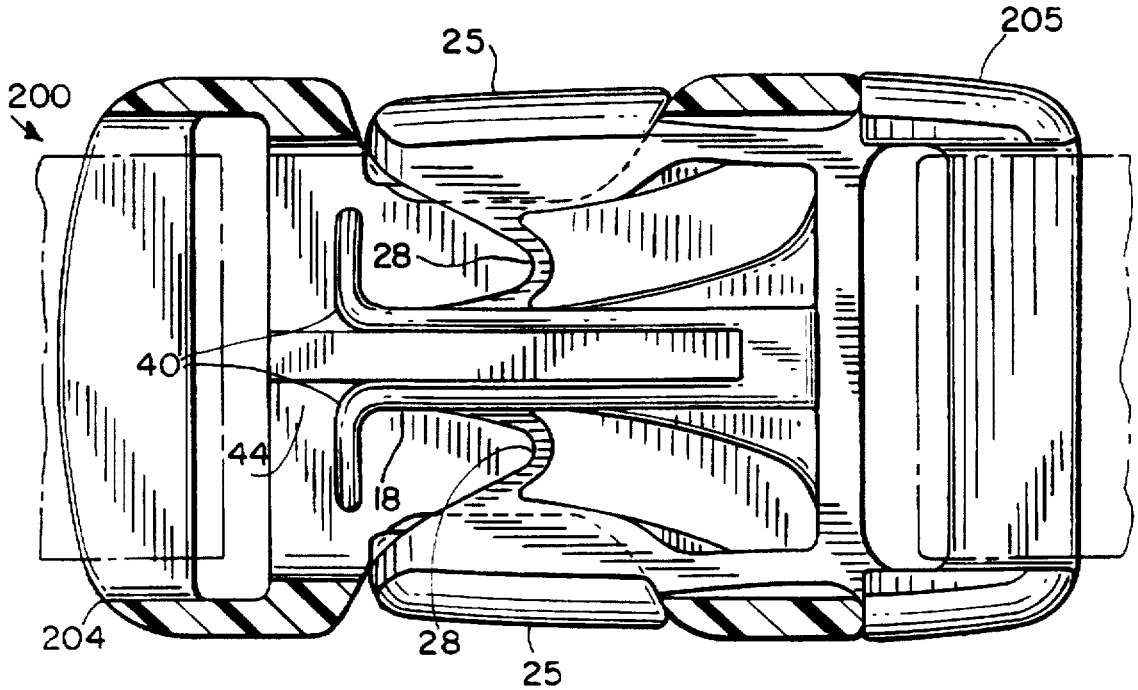
FIG. 8 is a top cross-sectional view of the buckle of FIG. 7 showing the interlocking of the male and female members.

A third exemplary embodiment of a side-release type buckle according to the present invention is shown in FIGS. 7 and 8. A buckle 200 has a male member 205 and a female member 204. Male member 205 is implemented in a manner similar to male member 5 of the first exemplary embodiment, except that center piece 18 is formed as multiple rigid center projections, for example, center projections 40. Likewise, female member 204 is implemented in a manner similar to female member 4 of the first exemplary embodiment, except that ribs 29 are formed as a middle rib 44.

As shown in FIGS. 7 and 8, restraining straps 28 are connected between each arm member 23 and each respective center projection 40, in a manner similar to that of the first exemplary embodiment. The operation of buckle 200 is thus similar to that of the first exemplary embodiment, allowing minimal resistance for the inward flexing of the arm members 23 and acting to limit the outward flexing of the arm members 23 to prevent breakage.

To releasably connect the male plug member 205 to the female socket member 204, the distal end 25 of each arm member 23 and each center projection 40 is inserted within the cavity 10. The distal ends 25 of each arm member 23 contact the side walls 13, 14 of the female member 204, while the center projection 40 straddle the middle rib 44 of the female member 204. As shown by FIG. 8, when the male plug member 205 is fully inserted, the protrusions 26 of the arm members 23 occupy apertures 15, and the center rib 44 occupies the space between center projection 40.

In the preceding specification, the invention has been described with reference to specific exemplary embodiments thereof. It will, however, be evident that various modifications and changes may be made thereunto without departing from the broader spirit and scope of the invention as set forth in the claims which follow. The specification and drawings are accordingly to be regarded in an illustrative rather than a restrictive sense.

What is claimed is:

1. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having a center piece and at least one arm member for insertion within said cavity of said socket member through said open end of said cavity;

at least one flexible fabric retaining member disposed between the at least one arm member and the center piece, the retaining member coupling the at least one arm member to the center piece, wherein outward flexing of the at least one arm member is restricted beyond a predetermined point; and means for coupling and decoupling of the plug member with the socket member.

2. The buckle according to claim 1, wherein the retaining member has a first end and a second end, and wherein the first end is coupled to the at least one arm member and the second end is coupled to the center piece.

3. The buckle according to claim 1, wherein the retaining member is a flexible retaining strap.

4. The buckle according to claim 1 wherein the means for coupling and decoupling includes a protrusion along an outer side surface of the at least one arm member and an aperture defined in at least one of the side walls of the socket member, wherein the protrusion is exposed through the aperture when the plug member is coupled to the socket member.

5. The buckle according to claim 4, wherein the protrusion is a rounded protrusion.

6. The buckle according to claim 1, wherein the plug member includes two arm members, the arm members running along opposite sides of the plug member, and wherein the center piece is disposed between the two arm members.

7. The buckle according to claim 6, wherein the retaining member is a flexible retaining strap.

8. The buckle according to claim 1, wherein the at least one retaining member is V-shaped, and the outward flexing of the at least one arm member is restricted when the retaining member is substantially straight.

9. The buckle according to claim 1, wherein the retaining member is the same material as the male plug member.

10. The buckle according to claim 1, wherein two retaining members are used between each of the at least one arm member and the center piece.

11. The buckle according to claim 10, wherein the two retaining members are V-shaped and arranged oppositely in a diamond arrangement.

12. The buckle according to claim 10, wherein the retaining members are flexible retaining straps.

13. The buckle according to claim 1, wherein the center piece includes a plurality of center projections, and each of the at least one flexible retaining member is disposed between each of the at least one arm member and each of the plurality of center projections.

14. A side release buckle, comprising:

a female socket member comprising a top wall, a bottom wall and a pair of opposing side walls connecting the top and bottom walls, the side walls and the top and bottom walls defining a cavity therebetween which is open at an open end thereof, and further comprising an aperture in each side wall;

a male plug member having a base, a center piece and two arm members for insertion within said cavity of said socket member through said open end of said cavity, the two arm members extending from the base substantially in parallel and from opposite sides of the base, the center piece extending from the base between the two arm members;

at least one flexible retaining member disposed between each of the two arm members and the center piece, the at least one retaining member having a first end coupled to a respective arm member and a second end coupled to the center piece, wherein outward flexing of the at least one arm member is restricted beyond a predetermined point when the at least one retaining member is substantially straight; and means for coupling and decoupling of the plug member with the socket member.

15. The buckle according to claim 14 wherein the retaining member is a flexible retaining strap.

16. The buckle according to claim 14 wherein the means for coupling and decoupling includes a protrusion along an outer side surface of each arm member and an aperture defined in the side walls of the socket member, wherein each protrusion is exposed through one aperture when the plug member is coupled to the socket member.

17. The buckle according to claim 16 wherein the protrusion is a rounded protrusion.

18. The buckle according to claim 14 wherein the at least one retaining member is V-shaped.

19. The buckle according to claim 14 wherein the retaining member is a fabric.

20. The buckle according to claim 14 wherein the retaining member is comprised of the same material as the male plug member.

21. The buckle according to claim 14 wherein there are two retaining members which are each V-shaped and which are arranged on opposite sides of the center piece so as to define a diamond configuration.

22. The buckle according to claim 21 wherein the retaining members are flexible retaining straps.

23. The buckle according to claim 14 wherein the center piece includes a plurality of center projections, and each of the at least one flexible retaining members is disposed between each of the arm members and each of the plurality of center projections.

24. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having a center piece and at least one arm member for insertion within said cavity of said socket member through said open end of said cavity;

at least one flexible V-shaped retaining member disposed between the at least one arm member and the center piece, the retaining member coupling the at least one arm member to the center piece, wherein outward flexing of the at least one arm member is restricted beyond a predetermined point when the retaining member is substantially straight; and means for coupling and decoupling of the plug member with the socket member.

25. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having two arm members and a center piece for insertion within said cavity of said socket member through said open end of said cavity, the arm members being disposed on opposite sides of the center piece;

two flexible retaining members between each arm member and the center piece, each retaining member being disposed between one arm member and the center piece, each retaining member coupling one arm member to the center piece, wherein outward flexing of the arm members is restricted beyond a predetermined point; and means for coupling and decoupling of the plug member with the socket member.

26. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having a center piece and at least one arm member for insertion within said cavity of said socket member through said open end of said cavity, the center piece including a plurality of center projections;

at least one flexible retaining member disposed between each of the at least one arm member and each of the plurality of center projections, the retaining member coupling the at least one arm member to the center piece, wherein outward flexing of the at least one arm member is restricted beyond a predetermined point; and means for coupling and decoupling of the plug member with the socket member.

* * * * *